US010417976B2

(12) United States Patent
Pan

(10) Patent No.: US 10,417,976 B2
(45) Date of Patent: Sep. 17, 2019

(54) PIXEL RENDERING METHOD AND PIXEL RENDERING DEVICE

(71) Applicant: WUHAN CHINA STAR OPTOELECTRONICS TECHNOLOGY CO., LTD., Wuhan, Hubei (CN)

(72) Inventor: Biao Pan, Wuhan (CN)

(73) Assignee: WUHAN CHINA STAR OPTOELECTRONICS TECHNOLOGY CO., LTD., Wuhan, Hubei (CN)

( * ) Notice: Subject to any disclaimer, the term of this patent is extended or adjusted under 35 U.S.C. 154(b) by 0 days.

(21) Appl. No.: 15/547,049

(22) PCT Filed: Apr. 18, 2017

(86) PCT No.: PCT/CN2017/080948
§ 371 (c)(1),
(2) Date: Jul. 27, 2017

(87) PCT Pub. No.: WO2018/170978
PCT Pub. Date: Sep. 27, 2018

(65) Prior Publication Data

US 2018/0277049 A1 Sep. 27, 2018

(51) Int. Cl.
*G09G 3/36* (2006.01)
*G09G 3/20* (2006.01)

(52) U.S. Cl.
CPC ..... *G09G 3/3607* (2013.01); *G09G 3/2074* (2013.01); *G09G 2340/0457* (2013.01); *G09G 2340/06* (2013.01); *G09G 2360/16* (2013.01)

(58) Field of Classification Search
CPC . G09G 3/3607; G09G 3/2074; G09G 2340/06
See application file for complete search history.

(56) References Cited

U.S. PATENT DOCUMENTS

2009/0059078 A1* 3/2009 Kim ..... G09G 3/3406 348/645
2010/0259556 A1* 10/2010 Inuzuka ..... G09G 3/3611 345/604
2011/0043552 A1* 2/2011 Brown Elliott ..... G09G 3/3406 345/694

(Continued)

FOREIGN PATENT DOCUMENTS

CN 105118413 A 12/2015
CN 105138317 A 12/2015

(Continued)

*Primary Examiner* — Yu Chen
(74) *Attorney, Agent, or Firm* — Kolisch Hartwell, P.C.

(57) ABSTRACT

A pixel rendering method and a pixel rendering device are disclosed. The method includes obtaining a grayscale value of a red, green, and blue (RGB) primary color weight of each pixel in an original image and converting the grayscale value into RGBW luminance values; determining a display mode of a pending pixel to be a text display mode or an image display mode; rendering the pending pixel based on the text display mode if the display mode of the pending pixel is on the text display mode; otherwise, rendering the pending pixel on the image display mode.

7 Claims, 4 Drawing Sheets

(56) References Cited

U.S. PATENT DOCUMENTS

| | | | | |
|---|---|---|---|---|
| 2012/0287147 | A1* | 11/2012 | Brown Elliott | G09G 5/02 345/593 |
| 2012/0287148 | A1* | 11/2012 | Brown Elliott | G09G 5/02 345/593 |
| 2013/0215360 | A1* | 8/2013 | Pollack | G09G 3/3413 349/61 |
| 2014/0043357 | A1* | 2/2014 | Yamato | G09G 3/3607 345/603 |
| 2016/0343312 | A1* | 11/2016 | Li | G09G 3/36 |
| 2017/0061843 | A1* | 3/2017 | Zhao | G09G 3/2003 |
| 2017/0200405 | A1 | 7/2017 | Li et al. | |
| 2017/0256193 | A1* | 9/2017 | Zhou | G09G 3/2003 |
| 2018/0012532 | A1 | 1/2018 | Jin | |

FOREIGN PATENT DOCUMENTS

| | | | |
|---|---|---|---|
| CN | 105263009 | A | 1/2016 |
| CN | 105336288 | A | 2/2016 |

* cited by examiner

PIXEL RENDERING METHOD AND PIXEL RENDERING DEVICE

BACKGROUND

1. Field of the Disclosure

The present disclosure relates to the technical field of liquid crystal display, and more particularly, to a pixel rendering method and a pixel rendering device.

2. Description of the Related Art

With the continual improvement of human living standards and display technology, the shortcomings of a traditional three primary color display system have emerged. Now it is hard to meet human growing demands. It mainly reflects on, along with the improvement of resolution of a display screen, a lowering aperture ratio of a pixel and a declining light penetration rate of the screen, resulting in a significant increase on the power consumption of the backlight and the screen.

Compared with a traditional red, green, and blue (RGB) display screen, a red, green, blue, and white (RGBW) display screen further includes white (W) sub-pixel, except for a red (R) sub-pixel, a green (G) sub-pixel, and a blue (B) sub-pixel. The addition of the white (W) sub-pixel can increase the penetration rate of a liquid crystal display (LCD) and the glow efficiency of a unit area of an organic light-emitting diode (OLED) display, which can achieve goals of low power consumption and friendly environment. Under the same pixel design, the addition of the shite (W) sub-pixel brings a decrease on the physical resolution. Therefore, to increase the actual resolution of the display, a sub-pixel rendering method (SPR) should be applied to the RGBW display device.

However, the RGBW display device using the traditional SPR method takes a risk of losing information on display detail to a certain degree because of some loss of sub-pixel signal in the process of converting an input RGB signal into an output RGBW signal. Meanwhile, text display and image display are totally different while the traditional SPR method does not distinguish one from the other; instead, text display and image display are treated equally. Since text display and image display are treated with the same method, text display may be not very bright, the details may be not clear, and image display may not be smooth.

SUMMARY

An object of the present disclosure is to propose a pixel rendering method and a pixel rendering device to solve the problems occurring in the related art. Conventionally, once the pixel is rendered, the resolution of the display is easily lowered, information carried by some pixels is readily lost, the luminance of text display is handily inadequate, the detail is not so clear, and image display is not very smooth.

According to one aspect of the present disclosure, a pixel rendering method comprises: obtaining a grayscale value of a red, green, and blue (RGB) primary color weight of each pixel in an original image and converting the grayscale value into a normalized luminance value; converting the normalized luminance value of the RGB primary color weight into a luminance value of a corresponding red, green, blue, and white (RGBW) weight; determining a display mode of a pending pixel to be a text display mode or an image display mode; rendering the pending pixel based on the text display mode if the display mode of the pending pixel is on the text display mode; otherwise, rendering the pending pixel on the image display mode; and converting the luminance value of the pending pixel after being rendered into a corresponding grayscale value for output.

Furthermore, the step of converting the luminance value of the normalized RGB primary color weight into the luminance value of the corresponding RGBW are calculated according to formulae as follows.

$$W1=\min(k*R_0,k*G_0,k*B_0,W_{max}),\ R1=k*R_0-W_0,$$

$$G1=k*G_0-W_0,\ B1=k*B_0-W_0,$$

where k indicates a gain coefficient and k≥1 is established; W1, R1, G1, and B1 are the converted luminance value of RGBW sub-pixels, respectively; $R_0$, $G_0$, and $B_0$ are the luminance values of the RGB sub-pixels before being converted, respectively; $W_{max}$ is the greatest luminance value of the W sub-pixel.

Furthermore, the step of determining a display mode of a pending pixel to be a text display mode or an image display mode comprises:

obtaining a luminance difference and a saturation difference between two pixels adjacent to the pending pixel;

comparing the luminance difference with a predetermined luminance difference threshold; comparing the saturation difference with a predetermined saturation difference threshold;

detecting whether the luminance difference is greater than the predetermined luminance difference threshold and whether the saturation difference is greater than the predetermined saturation difference threshold;

determining a display mode of a pending pixel to be a text display mode or an image display mode if true; detecting the display mode of the pending pixel to be the image display mode if not.

Furthermore, the step of rendering the pending pixel on the image display mode comprises:

obtaining luminance values of the RGBW sub-pixels of a first pixel, a second pixel, and a third pixel arranged adjacently from left to right in the same row, assigning the first pixel as the pending pixel, and calculating luminance values of the W sub-pixel, the R sub-pixel, the G sub-pixel, and the B sub-pixel of the pending pixel after being rendered according to the following formula:

$$W1_{out}=(W1+W2+W3)/3,\ R1_{out}=(R1+R2+R3)/3,$$

$$G1_{out}=(G1+G2+G3)/3,\ B1_{out}=(B1+B2+B3)/3,$$

where $W1_{out}$, $R1_{out}$, $G1_{out}$, and $B1_{out}$ are the luminance values of the W sub-pixel, the R sub-pixel, the G sub-pixel, and the B sub-pixel of the pending pixel after being rendered, respectively, W1, R1, G1, and B1 indicate the luminance values of the W sub-pixel, the R sub-pixel, the G sub-pixel, and the B sub-pixel of the first pixel, respectively, W2, R2, G2, and B2 indicate the luminance values of the W sub-pixel, the R sub-pixel, the G sub-pixel, and the B sub-pixel of the second pixel, respectively, and W3, R3, G3, and B3 indicate the luminance values of the W sub-pixel, the R sub-pixel, the G sub-pixel, and the B sub-pixel of the third pixel, respectively.

Furthermore, the step of rendering the pending pixel on the text display mode comprises:

obtaining luminance values of the RGBW sub-pixels of a first pixel and a second pixel arranged adjacently from left to right in the same row, assigning the first pixel as the pending pixel, and calculating luminance values of the W sub-pixel, the R sub-pixel, the G sub-pixel, and the B sub-pixel of the pending pixel after being rendered according to the following formula:

$$P1=W1+(R1+G1+B1)/3,\ P2=W2+(R2+G2+B2)/3,$$

when P1>P2, $W1_{out}$=(P1+W2)/2, $R1_{out}$=P2, $G1_{out}$=P2, and $B1_{out}$=P2, when P1<P2, $W1_{out}$=P1, $R1_{out}$=(R1+R2)/2, $G1_{out}$=(G1+G2)/2, $B1_{out}$=(B1+B2)/2, where $W1_{out}$, $R1_{out}$, $G1_{out}$, and $B1_{out}$ are the luminance values of the W sub-pixel, the R sub-pixel, the G sub-pixel, and the B sub-pixel of the pending pixel after being rendered; W1, R1, G1, and B1 indicate the luminance values of the W sub-pixel, the R sub-pixel, the G sub-pixel, and the B sub-pixel of the first pixel, respectively; W2, R2, G2, and B2 indicate the luminance values of the W sub-pixel, the R sub-pixel, the G sub-pixel, and the B sub-pixel of the second pixel, respectively.

Furthermore, the step of rendering the pending pixel on the image display mode comprises:

obtaining luminance values of the RGBW sub-pixels of a first pixel, a second pixel, and a third pixel arranged adjacently from left to right in the same row, assigning the first pixel as the pending pixel, and calculating luminance values of the W sub-pixel, the R sub-pixel, the G sub-pixel, and the B sub-pixel of the pending pixel after being rendered according to the following formula:

$$W1_{out}=a_1*W1+a_2*W2+a_3*W3,\ R1_{out}=a_1*R1+a_2*R2+a_3*R3,$$

$$G1_{out}=a_1*G1+a_2*G2+a_3*G3,\ B1_{out}=a_1*B1+a_2*B2+a_3*B3,$$

where $a_1$, $a_2$, and $a_3$ are all weighting coefficients, and $0\le a_1\le 1$, $0\le a_2\le 1$, $0\le a_3\le 1$, and $a_1+a_2+a_3=1$; $W1_{out}$, $R1_{out}$, $G1_{out}$, and $B1_{out}$ are the luminance values of the W sub-pixel, the R sub-pixel, the G sub-pixel, and the B sub-pixel of the pending pixel after being rendered, respectively; W1, R1, G1, and B1 indicate the luminance values of the W sub-pixel, the R sub-pixel, the G sub-pixel, and the B sub-pixel of the first pixel, respectively; W2, R2, G2, and B2 indicate the luminance values of the W sub-pixel, the R sub-pixel, the G sub-pixel, and the B sub-pixel of the second pixel, respectively; W3, R3, G3, and B3 indicate the luminance values of the W sub-pixel, the R sub-pixel, the G sub-pixel, and the B sub-pixel of the third pixel, respectively.

Furthermore, the weighting coefficients $a_1$ equals 0.25, $a_2$ equals 0.5 and $a_3$ equals 0.25.

Furthermore, the step of rendering the pending pixel on the text display mode comprises:

obtaining luminance values of the RGBW sub-pixels of a first pixel and a second pixel arranged adjacently from left to right in the same row, assigning the first pixel as the pending pixel, and calculating luminance values of the W sub-pixel, the R sub-pixel, the G sub-pixel, and the B sub-pixel of the pending pixel after being rendered according to the following formula:

$$P1=W1+(R1+G1+B1)/3,\ P2=W2+(R2+G2+B2)/3,$$

when P1>P2, $W1_{out}$=min{(P1+W2)/2,1}, $R1_{out}$=R2, $G1_{out}$=G2, $B1_{out}$=B2, when P1<P2, $W1_{out}$=W1, $R1_{out}$=min{(R1+P2)/2,1}, $G1_{out}$=min{(G1+P2)/2,1}, and $B1_{out}$=min{(B1+P2)/2,1}, where $W1_{out}$, $R1_{out}$, $G1_{out}$, and $B1_{out}$ are the luminance values of the W sub-pixel, the R sub-pixel, the G sub-pixel, and the B sub-pixel of the pending pixel after being rendered, respectively; W1, R1, G1, and B1 indicate the luminance values of the W sub-pixel, the R sub-pixel, the G sub-pixel, and the B sub-pixel of the first pixel, respectively; W2, R2, G2, and B2 indicate the luminance values of the W sub-pixel, the R sub-pixel, the G sub-pixel, and the B sub-pixel of the second pixel, respectively.

According to another aspect of the present disclosure, a pixel rendering device includes: a grayscale value obtaining module, configured to obtain a grayscale value of a red, green, and blue (RGB) primary color weight of each pixel of an original image; a first conversion module, configured to convert the grayscale value of the RGB primary color weight into a normalized luminance value; a second conversion module, configured to convert the normalized luminance value of the RGB primary color weight into luminance values of a corresponding red, green, blue, and white (RGBW) sub-pixels; a pattern detection module, configured to detect a display mode of a pending pixel to be a text display mode or a image display mode; a text rendering module, configured to render the pixel based on the text display mode when the display mode of the pending pixel is the text display mode; an image rendering module, configured to render the pixel based on the image display mode when the display mode of the pending pixel is the image display mode; and a conversion output module, configured to convert the luminance value of the pending pixel after being rendered into a corresponding grayscale value for output.

Furthermore, the pattern detection module comprises: a difference obtain unit, configured to obtain the luminance difference and saturation difference between two pixels adjacent to the pending pixel; a comparison unit, configured to compare the luminance difference with a predetermined luminance difference threshold and to compare the saturation difference with a predetermined saturation difference threshold; and a pattern detection unit, configured to detect the display mode of the pending pixel to be the text display mode upon conditions that the luminance difference is greater than the predetermined luminance difference threshold and the saturation difference is greater than the predetermined saturation difference threshold, otherwise, configured to detect the display mode of the pending pixel to be the image display mode.

According to still another one aspect of the present disclosure, a pixel rendering method comprises: obtaining a grayscale value of a red, green, and blue (RGB) primary color weight of each pixel in an original image and converting the grayscale value into a normalized luminance value; converting the normalized luminance value of the RGB primary color weight into a luminance value of a corresponding red, green, blue, and white (RGBW) weight; determining a display mode of a pending pixel to be a text display mode or an image display mode; rendering the pending pixel based on the text display mode if the display mode of the pending pixel is on the text display mode; otherwise, rendering the pending pixel on the image display mode; converting the luminance value of the pending pixel after being rendered into a corresponding grayscale value for output.

The step of converting the luminance value of the normalized RGB primary color weight into the luminance value of the corresponding RGBW are calculated according to formulae as follows:

$$W1=\min(k*R_0,k*G_0,k*B_0,W_{max}),\ R1=k*R_0-W_0,$$

$$G1=k*G_0-W_0,\ B1=k*B_0-W_0,$$

where k indicates a gain coefficient and $k \geq 1$ is established; W1, R1, G1, and B1 are the converted luminance value of RGBW sub-pixels, respectively; $R_0$, $G_0$, and $B_0$ are the luminance values of the RGB sub-pixels before being converted, respectively; $W_{max}$ is the greatest luminance value of the W sub-pixel; and wherein the step of determining a display mode of a pending pixel to be a text display mode or an image display mode comprises:

obtaining a luminance difference and a saturation difference between two pixels adjacent to the pending pixel;

comparing the luminance difference with a predetermined luminance difference threshold; comparing the saturation difference with a predetermined saturation difference threshold;

detecting whether the luminance difference is greater than the predetermined luminance difference threshold and whether the saturation difference is greater than the predetermined saturation difference threshold;

determining a display mode of a pending pixel to be a text display mode or an image display mode if true; detecting the display mode of the pending pixel to be the image display mode if not.

Furthermore, the step of rendering the pending pixel on the image display mode comprises:

obtaining luminance values of the RGBW sub-pixels of a first pixel, a second pixel, and a third pixel arranged adjacently from left to right in the same row, assigning the first pixel as the pending pixel, and calculating luminance values of the W sub-pixel, the R sub-pixel, the G sub-pixel, and the B sub-pixel of the pending pixel after being rendered according to the following formula:

$$W1_{out}=(W1+W2+W3)/3,\ R1_{out}=(R1+R2+R3)/3,$$

$$G1_{out}=(G1+G2+G3)/3,\ B1_{out}=(B1+B2+B3)/3,$$

where $W1_{out}$, $R1_{out}$, $G1_{out}$, and $B1_{out}$ are the luminance values of the W sub-pixel, the R sub-pixel, the G sub-pixel, and the B sub-pixel of the pending pixel after being rendered, respectively, W1, R1, G1, and B1 indicate the luminance values of the W sub-pixel, the R sub-pixel, the G sub-pixel, and the B sub-pixel of the first pixel, respectively, W2, R2, G2, and B2 indicate the luminance values of the W sub-pixel, the R sub-pixel, the G sub-pixel, and the B sub-pixel of the second pixel, respectively, and W3, R3, G3, and B3 indicate the luminance values of the W sub-pixel, the R sub-pixel, the G sub-pixel, and the B sub-pixel of the third pixel, respectively.

Furthermore, the step of rendering the pending pixel on the text display mode comprises:

obtaining luminance values of the RGBW sub-pixels of a first pixel and a second pixel arranged adjacently from left to right in the same row, assigning the first pixel as the pending pixel, and calculating luminance values of the W sub-pixel, the R sub-pixel, the G sub-pixel, and the B sub-pixel of the pending pixel after being rendered according to the following formula:

$$P1=W1+(R1+G1+B1)/3,\ P2=W2+(R2+G2+B2)/3,$$

when P1>P2, $W1_{out}$=(P1+W2)/2, $R1_{out}$=P2, $G1_{out}$=P2, and $B1_{out}$=P2, when P1<P2, $W1_{out}$=P1, $R1_{out}$=(R1+R2)/2, $G1_{out}$=(G1+G2)/2, $B1_{out}$=(B1+B2)/2, where $W1_{out}$, $R1_{out}$, $G1_{out}$, and $B1_{out}$ are the luminance values of the W sub-pixel, the R sub-pixel, the G sub-pixel, and the B sub-pixel of the pending pixel after being rendered; W1, R1, G1, and B1 indicate the luminance values of the W sub-pixel, the R sub-pixel, the G sub-pixel, and the B sub-pixel of the first pixel, respectively; W2, R2, G2, and B2 indicate the luminance values of the W sub-pixel, the R sub-pixel, the G sub-pixel, and the B sub-pixel of the second pixel, respectively.

Furthermore, the step of rendering the pending pixel on the image display mode comprises:

obtaining luminance values of the RGBW sub-pixels of a first pixel, a second pixel, and a third pixel arranged adjacently from left to right in the same row, assigning the first pixel as the pending pixel, and calculating luminance values of the W sub-pixel, the R sub-pixel, the G sub-pixel, and the B sub-pixel of the pending pixel after being rendered according to the following formula:

$$W1_{out}=a_1*W1+a_2*W2+a_3*W3,\ R1_{out}=a_1*R1+a_2*R2+a_3*R3,$$

$$G1_{out}=a_1*G1+a_2*G2+a_3*G3,\ B1_{out}=a_1*B1+a_2*B2+a_3*B3,$$

where $a_1$, $a_2$, and $a_3$ are all weighting coefficients, and $0 \leq a_1 \leq 1$, $0 \leq a_2 \leq 1$, $0 \leq a_3 \leq 1$, and $a_1+a_2+a_3=1$; $W1_{out}$, $R1_{out}$, $G1_{out}$, and $B1_{out}$ are the luminance values of the W sub-pixel, the R sub-pixel, the G sub-pixel, and the B sub-pixel of the pending pixel after being rendered, respectively; W1, R1, G1, and B1 indicate the luminance values of the W sub-pixel, the R sub-pixel, the G sub-pixel, and the B sub-pixel of the first pixel, respectively; W2, R2, G2, and B2 indicate the luminance values of the W sub-pixel, the R sub-pixel, the G sub-pixel, and the B sub-pixel of the second pixel, respectively; W3, R3, G3, and B3 indicate the luminance values of the W sub-pixel, the R sub-pixel, the G sub-pixel, and the B sub-pixel of the third pixel, respectively.

Furthermore, the weighting coefficients $a_1$ equals 0.25, $a_2$ equals 0.5 and $a_3$ equals 0.25.

Furthermore, the step of rendering the pending pixel on the text display mode comprises:

obtaining luminance values of the RGBW sub-pixels of a first pixel and a second pixel arranged adjacently from left to right in the same row, assigning the first pixel as the pending pixel, and calculating luminance values of the W sub-pixel, the R sub-pixel, the G sub-pixel, and the B sub-pixel of the pending pixel after being rendered according to the following formula:

$$P1=W1+(R1+G1+B1)/3,\ P2=W2+(R2+G2+B2)/3,$$

when P1>P2, $W1_{out}$=min{(P1+W2)/2,1}, $R1_{out}$=R2, $G1_{out}$=G2, $B1_{out}$=B2, when P1<P2, $W1_{out}$=W1, $R1_{out}$=min{(R1+P2)/2,1}, $G1_{out}$=min{(G1+P2)/2,1}, and $B1_{out}$=min{(B1+P2)/2,1}, where $W1_{out}$, $R1_{out}$, $G1_{out}$, and $B1_{out}$ are the luminance values of the W sub-pixel, the R sub-pixel, the G sub-pixel, and the B sub-pixel of the pending pixel after being rendered, respectively; W1, R1, G1, and B1 indicate the luminance values of the W sub-pixel, the R sub-pixel, the G sub-pixel, and the B sub-pixel of the first pixel, respectively; W2, R2, G2, and B2 indicate the luminance values of the W sub-pixel, the R sub-pixel, the G sub-pixel, and the B sub-pixel of the second pixel, respectively.

The advantages of the present disclosure are that:

A pixel rendering method and a pixel rendering device are disclosed by the present disclosure where the display mode of a pending pixel is detected to be a text display mode. If the display mode of a pending pixel is a text display mode, the pixel is rendered on the text display mode. If not, the pixel is rendered on the image display mode. The advantages of the present disclosure are as follows.

First, the actual resolution of a display panel does not lower even though the physical resolution of the display panel reduces.

Second, each piece of the pixel information was retained, which implies that no shown details are lost.

Third, the display mode of the pending pixel is detected and the text and image display modes are treated differently in the present disclosure. The display effect of the treated image display is smoother and better, especially, image display on humans. The display effect of the treated text display is sharper in black and white text and more accurate in details.

DETAILED DESCRIPTION OF THE PREFERRED EMBODIMENTS

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures.

Embodiment 1

Figure 1:
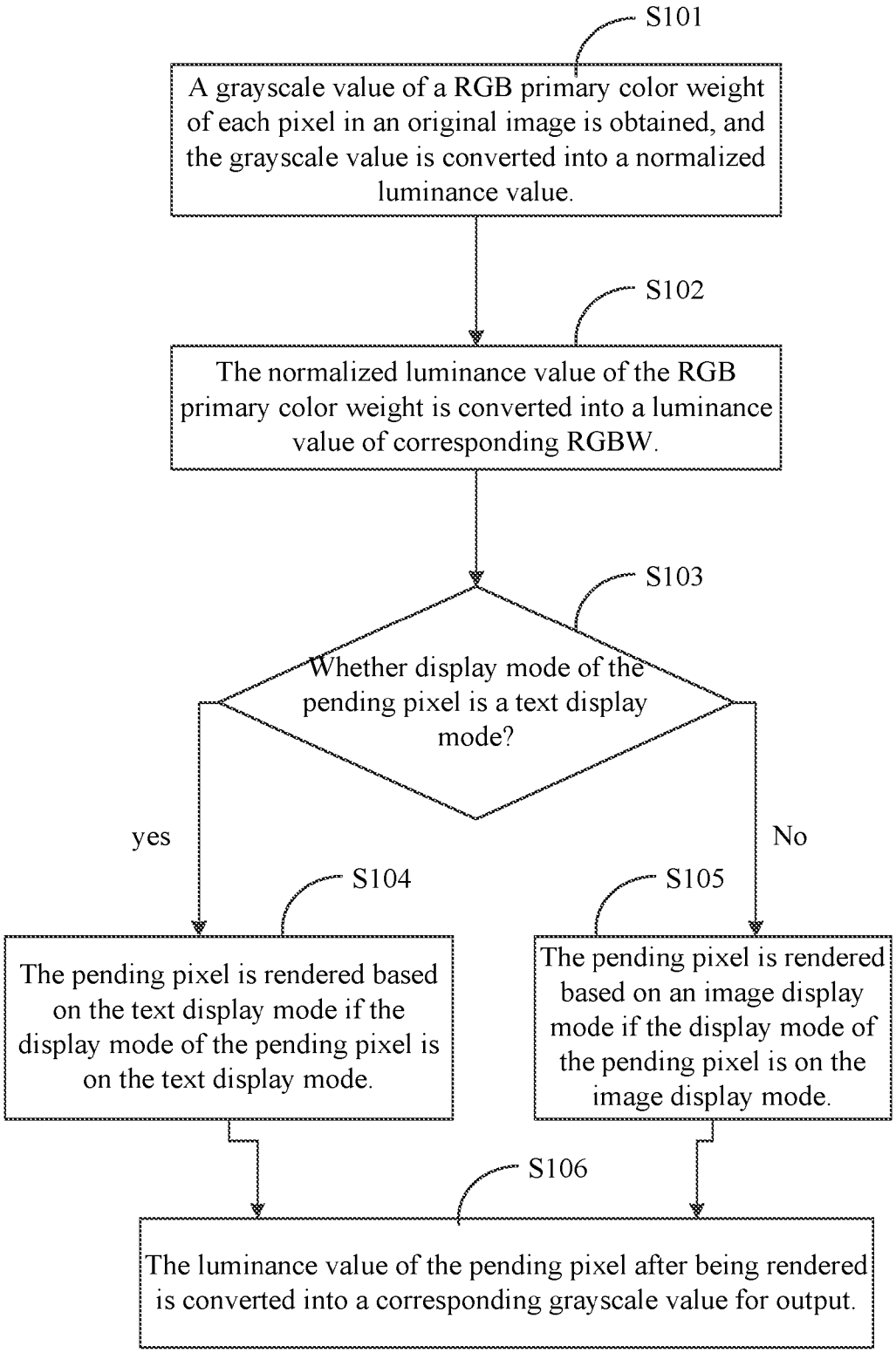
FIG. 1 is a flowchart of all steps of a pixel rendering method according to an embodiment of the present disclosure.
Figure 2:
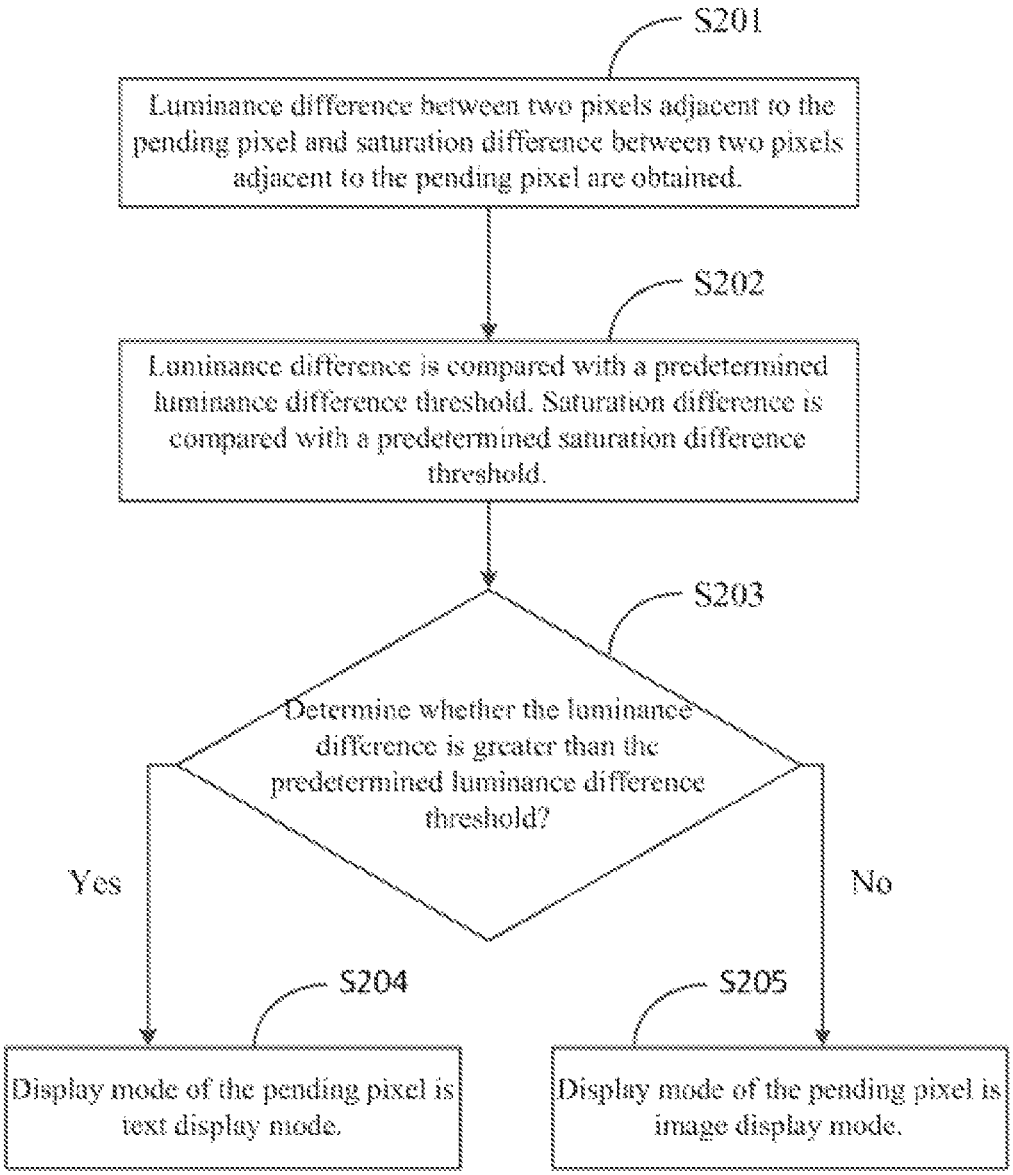
FIG. 2 is a flowchart of steps of a pixel rendering method of detecting a display mode of a pending pixel on a text display mode.

Please refer to FIG. 1 and FIG. 2. FIG. 1 is a flowchart of all steps of a pixel rendering method according to an embodiment of the present disclosure. FIG. 2 is a flowchart of steps of a pixel rendering method of detecting a display mode of a pending pixel on a text display mode. The pixel rendering method includes following steps.

Step S101: A grayscale value of a RGB primary color weight of each pixel in an original image is obtained, and the grayscale value is converted into a normalized luminance value. The grayscale value of the RGB primary color weight of each pixel in the original image is converted into the normalized luminance value with the De-Gamma conversion method in this step. A formulas for calculation is used in the De-Gamma conversion method.

$$y_1=(x_1/255)^{gamma};$$

where $y_1$ indicates the luminance value of the normalized RGBW, and $x_1$ indicates the grayscale value of the RGB which is not normalized.

Step S102: The normalized luminance value of the RGB primary color weight is converted into a luminance value of corresponding RGBW.

Step S103: The display mode of the pending pixel is detected to be a text display mode.

Step S104: The pending pixel is rendered based on the text display mode if the display mode of the pending pixel is on the text display mode.

Step S105: The pending pixel is rendered based on an image display mode if the display mode of the pending pixel is on the image display mode.

Step S106: The luminance value of the pending pixel after being rendered is converted into a corresponding grayscale value for output.

The luminance value of the rendered pending pixel with the Gamma conversion method is converted into the corresponding grayscale value in this step. Especially, the formula is as follows.

$$Y_2=(x_2/255)^{1/gamma};$$

where $y_2$ indicates the grayscale value of the converted RGBW, and $x_2$ indicates the luminance value of the RGB which is not converted.

The luminance value of the normalized RGB primary color weight is converted into the luminance value of the corresponding RGBW. Some formulae for calculation are used as follows.

$$W1=\min(k*R_0,k*G_0,k*B_0,W_{max}),\ R1=k*R_0-W_0,$$

$$G1=k*G_0-W_0,\ B1=k*B_0-W_0,$$

where k indicates a gain coefficient and k≥1 is established; W1, R1, G1, and B1 are the converted luminance value of the RGBW sub-pixels, respectively; $R_0$, $G_0$, and $B_0$ are the luminance values of the RGB sub-pixels before being converted, respectively; $W_{max}$ is the greatest luminance value of the W sub-pixel.

As FIG. 2 shows, the display mode of the pending pixel is detected to be a text display mode in this embodiment. The embodiment includes steps as follows.

Step S201: The luminance difference between two pixels adjacent to the pending pixel is obtained. Also, the saturation difference between two pixels adjacent to the pending pixel is obtained.

Step S202: The luminance difference is compared with a predetermined luminance difference threshold. Also, the saturation difference is compared with a predetermined saturation difference threshold.

Step S203: Whether the luminance difference is greater than the predetermined luminance difference threshold is detected. Also, whether the saturation difference is greater than the predetermined saturation difference threshold is detected.

Step S204: The display mode of the pending pixel is detected to be the text display mode if the luminance difference is greater than the predetermined luminance difference threshold, and the saturation difference threshold is greater than the predetermined saturation difference threshold.

Step S205: The display mode of the pending pixel is detected to be the image display mode if the luminance difference is greater than the predetermined luminance difference threshold, and the saturation difference threshold greater than the predetermined saturation difference threshold is not established.

The pixel is rendered based on the image display modes in this embodiment, especially:

The luminance values of the RGBW of a first pixel, a second pixel, and a third pixel arranged adjacently from left to right in the same row are obtained. The first pixel is the pending pixel and calculated according to the following formulae:

$$W1_{out}=(W1+W2+W3)/3,\ R1_{out}=(R1+R2+R3)/3,$$

$$G1_{out}=(G1+G2+G3)/3,\ B1_{out}=(B1+B2+B3)/3,$$

where $W1_{out}$, $R1_{out}$, $G1_{out}$, and $B1_{out}$ are the luminance values of the W sub-pixel, the R sub-pixel, the G sub-pixel, and the B sub-pixel of the pending pixel after being rendered, respectively, W1, R1, G1, and B1 indicate the luminance values of the W sub-pixel, the R sub-pixel, the G sub-pixel, and the B sub-pixel of the first pixel, respectively, W2, R2, G2, and B2 indicate the luminance values of the W sub-pixel, the R sub-pixel, the G sub-pixel, and the B sub-pixel of the second pixel, respectively, and W3, R3, G3, and B3 indicate the luminance values of the W sub-pixel, the R sub-pixel, the G sub-pixel, and the B sub-pixel of the third pixel, respectively.

The pixel is rendered based on the text display mode in this embodiment. The method includes:

The luminance values of the RGBW of the first pixel and the second pixel arranged adjacently from left to right in the same row are obtained. The first pixel is the pending pixel and calculated according to the following formulae:

$$P1=W1+(R1+G1+B1)/3,\ P2=W2+(R2+G2+B2)/3,$$

When P1>P2 is established, $W1_{out}$=(P1+W2)/2, $R1_{out}$=P2, $G1_{out}$=P2, and $B1_{out}$=P2 are established.

When P1<P2 is established, $W1_{out}$=P1, $R1_{out}$=(R1+R2)/2, $G1_{out}$=(G1+G2)/2, $B1_{out}$=(B1+B2)/2 are established as well.

$W1_{out}$, $R1_{out}$, $G1_{out}$, and $B1_{out}$ are the luminance values of the W sub-pixel, the R sub-pixel, the G sub-pixel, and the B sub-pixel of the pending pixel after being rendered, respectively. W1, R1, G1, and B1 indicate the luminance values of the W sub-pixel, the R sub-pixel, the G sub-pixel, and the B sub-pixel of the first pixel, respectively. W2, R2, G2, and B2 indicate the luminance values of the W sub-pixel, the R sub-pixel, the G sub-pixel, and the B sub-pixel of the second pixel, respectively.

If the luminance values of the RGBW of a first pixel, a second pixel, a third pixel, and a fourth pixel arranged adjacently from left to right in the same row are obtained, the first pixel is the pending pixel and calculated according to the following formulae:

$$P1=W1+(R1+G1+B1)/3,\ P2=W2+(R2+G2+B2)/3,$$

$$P3=W3+(R3+G3+B3)/3,\ P4=W4+(R4+G4+B4)/3,$$

If the luminance value of a virtual pixel on the left is greater than the luminance value of a virtual pixel on the right, for example, P1>P2, $W1_{out}$=(P1+W2)/2, $R1_{out}$=P2, $G1_{out}$=P2, and $B1_{out}$=P2 are established.

If the luminance value of the virtual pixel on the left is less than the luminance value of the virtual pixel on the right, for example, P3<P4, $W2_{out}$=P3, $R2_{out}$=(R3+R4)/2, $G2_{out}$=(G3+G4)/2, and $B2_{out}$=(B3+B4)/2 are established.

$W1_{out}$, $R1_{out}$, $G1_{out}$, and $B1_{out}$ are the luminance values of the W sub-pixel, the R sub-pixel, the G sub-pixel, and the B sub-pixel of the first pending pixel after being rendered, respectively. $W2_{out}$, $R2_{out}$, $G2_{out}$, and $B2_{out}$ are the luminance values of the W sub-pixel, the R sub-pixel, the G sub-pixel, and the B sub-pixel of the second pending pixel after being rendered, respectively. W1, R1, G1, and B1 indicate the luminance values of the W sub-pixel, the R sub-pixel, the G sub-pixel, and the B sub-pixel of the first pixel, respectively. W2, R2, G2, and B2 indicate the luminance values of the W sub-pixel, the R sub-pixel, the G sub-pixel, and the B sub-pixel of the second pixel, respectively. W3, R3, G3, and B3 indicate the luminance values of the W sub-pixel, the R sub-pixel, the G sub-pixel, and the B sub-pixel of the pixel on the right, respectively. W4, R4, G4, and B4 indicate the luminance values of the W sub-pixel, the R sub-pixel, the G sub-pixel, and the B sub-pixel of the pixel on the right, respectively.

According to the pixel rendering method of the present disclosure, the display mode of a pending pixel is detected to be a text display mode. If the display mode of a pending pixel is a text display mode, the pixel is rendered on the text display mode. If not, the pixel is rendered on the image display mode. The advantages of the present disclosure are as follows.

First, the actual resolution of a display panel does not lower even though the physical resolution of the display panel reduces.

Second, each piece of the pixel information was retained, which implies that no shown details are lost.

Third, the display mode of the pending pixel is detected and the text and image display modes are treated differently in the present disclosure. The display effect of the treated image display is smoother and better, especially, image display on humans. The display effect of the treated text display is sharper in black and white text and more accurate in details.

Embodiment 2

Basically, a second preferred embodiment is the same as the first embodiment, except:

Differing from the method introduced in the first embodiment, a pixel is rendered based on a text display mode in this embodiment, especially:

The luminance values of a red, green, blue, and white (RGBW) of a first pixel, a second pixel, and a third pixel arranged adjacently from left to right in the same row are obtained. The first pixel is the pending pixel and calculated according to formulae as follows.

$$W1_{out}=a_1*W1+a_2*W2+a_3*W3,\ R1_{out}=a_1*R1+a_2*R2+a_3*R3,$$

$$G1_{out}=a_1*G1+a_2*G2+a_3*G3,\ B1_{out}=a_2*B1+a_2*B2+a_3*B3,$$

where $a_1$, $a_2$, and $a_3$ are all weighting coefficients, and $0\le a_1\le 1$, $0\le a_2\le 1$, $0\le a_3\le 1$, and $a_1+a_2+a_3=1$; $W1_{out}$, $R1_{out}$, $G1_{out}$, and $B1_{out}$ are the luminance values of the W sub-pixel, the R sub-pixel, the G sub-pixel, and the B sub-pixel of the pending pixel after being rendered, respectively. W1, R1, G1, and B1 indicate the luminance values of the W sub-pixel, the R sub-pixel, the G sub-pixel, and the B sub-pixel of the first pixel, respectively. W2, R2, G2, and B2 indicate the luminance values of the W sub-pixel, the R sub-pixel, the G sub-pixel, and the B sub-pixel of the second pixel, respectively; W3, R3, G3, and B3 indicate the luminance values of the W sub-pixel, the R sub-pixel, the G sub-pixel, and the B sub-pixel of the third pixel, respectively.

Preferably, the weighting coefficient is $a_1$=0.25 in this embodiment where $a_2$=0.5 and $a_3$=0.25 are established.

Differing from the method introduced in the first embodiment, the pixel is rendered based on the text display mode in this embodiment. The method includes:

The luminance values of the RGBW of a first pixel and a second pixel arranged adjacently from left to right in the same row are obtained. The first pixel is the pending pixel and calculated according to the following formulae:

$$P1=W1+(R1+G1+B1)/3,\ P2=W2+(R2+G2+B2)/3,$$

When P1>P2, is established, $W1_{out}$=min{(P1+W2)/2,1}, $R1_{out}$=R2, $G1_{out}$=G2, $B1_{out}$=B2, are established.

When P1<P2, is established, $W1_{out}$=W1, $R1_{out}$=min{(R1+P2)/2,1}, $G1_{out}$=min{(G1+P2)/2,1}, and $B1_{out}$=min{(B1+P2)/2,1} are established as well.

$W1_{out}$, $R1_{out}$, $G1_{out}$, and $B1_{out}$ are the luminance values of the W sub-pixel, the R sub-pixel, the G sub-pixel, and the B sub-pixel of the pending pixel after being rendered, respectively. W1, R1, G1, and B1 indicate the luminance values of the W sub-pixel, the R sub-pixel, the G sub-pixel, and the B sub-pixel of the first pixel, respectively. W2, R2, G2, and B2 indicate the luminance values of the W sub-pixel, the R sub-pixel, the G sub-pixel, and the B sub-pixel of the second pixel, respectively.

More broadly, if the luminance values of the RGBW of a first pixel, a second pixel, a third pixel, and a fourth pixel arranged adjacently from left to right in the same row are obtained in this embodiment, the first pixel is the pending pixel and calculated according to the following formulae:

$$P1=W1+(R1+G1+B1)/3,\ P2=W2+(R2+G2+B2)/3,$$

$$P3=W3+(R3+G3+B3)/3,\ P4=W4+(R4+G4+B4)/3,$$

If the luminance value of a virtual pixel on the left is greater than the luminance value of the virtual pixel on the right, for example, P1>P2, $W1_{out}$=min{(P1+W2)/2,1}, $R1_{out}$=R2, $G1_{out}$=G2, and $B1_{out}$=B2 are established.

If the luminance value of the virtual pixel on the left is less than the luminance value of the virtual pixel on the right, for example, P3<P4, $W2_{out}$=W3, $R2_{out}$={(R3+R4)/2,1}, $G2_{out}$={(G3+P4)/2,1}, and $B2_{out}$=min{(B3+P4)/2,1} are established.

$W1_{out}$, and $R1_{out}$, $G1_{out}$, and $B1_{out}$ are the luminance values of the W sub-pixel, the R sub-pixel, the G sub-pixel, and the B sub-pixel of the first pending pixel after being rendered, respectively. $W2_{out}$, $R2_{out}$, $G2_{out}$, and $B2_{out}$ are the luminance values of the W sub-pixel, the R sub-pixel, the G sub-pixel, and the B sub-pixel of the second pending pixel after being rendered, respectively. W1, R1, G1, and B1 indicate the luminance values of the W sub-pixel, the R sub-pixel, the G sub-pixel, and the B sub-pixel of the first pixel, respectively. W2, R2, G2, and B2 indicate the luminance values of the W sub-pixel, the R sub-pixel, the G sub-pixel, and the B sub-pixel of the second pixel, respectively. W3, R3, G3, and B3 indicate the luminance values of the W sub-pixel, the R sub-pixel, the G sub-pixel, and the B sub-pixel of the third pixel, respectively. W4, R4, G4, and B4 indicate the luminance values of the W sub-pixel, the R sub-pixel, the G sub-pixel, and the B sub-pixel of the fourth pixel, respectively.

According to the pixel rendering method of the present disclosure, the display mode of a pending pixel is detected to be a text display mode. If the display mode of a pending pixel is a text display mode, the pixel is rendered on the text display mode. If not, the pixel is rendered on the image display mode. The advantages of the present disclosure are as follows.

First, the actual resolution of a display panel does not lower even though the physical resolution of the display panel reduces.

Second, each piece of the pixel information was retained, which implies that no shown details are lost.

Third, the display mode of the pending pixel is detected and the text and image display modes are treated differently in the present disclosure. The display effect of the treated image display is smoother and better, especially, image display on humans. The display effect of the treated text display is sharper in black and white text and more accurate in details.

Embodiment 3

Figure 3:
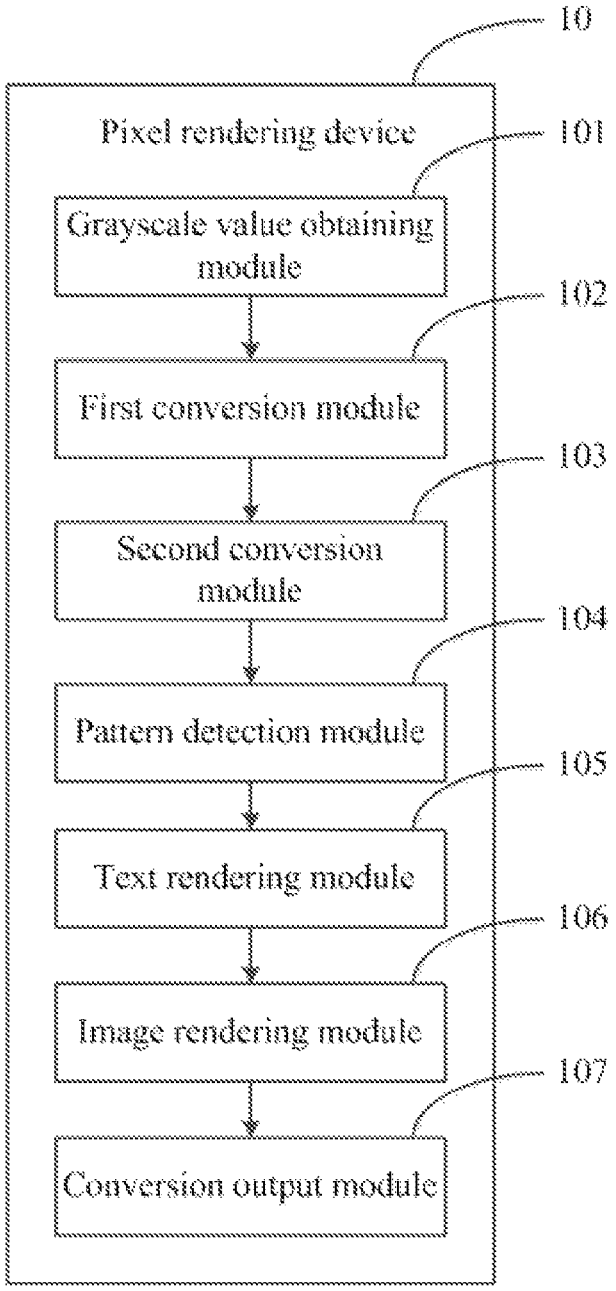
FIG. 3 is a schematic diagram of a pixel rendering device according to a another embodiment.
Figure 4:
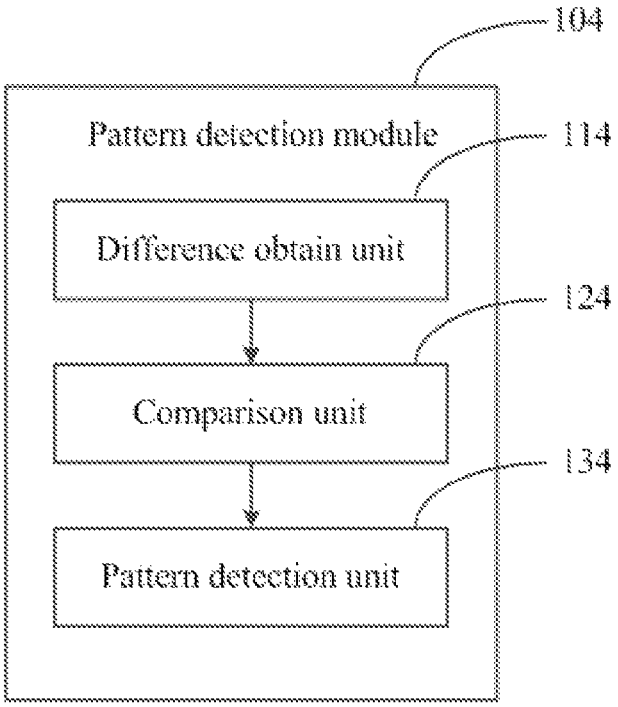
FIG. 4 is a schematic diagram of the structure of a pattern detection module of the pixel rendering device according to the preferred embodiment.

Please refer to FIG. 3 and FIG. 4. FIG. 3 is a schematic diagram of a pixel rendering device 10 according to a another embodiment. FIG. 4 is a schematic diagram of the structure of a pattern detection module 104 of the pixel rendering device 10 according to the preferred embodiment. The pixel rendering device 10 includes following components.

A grayscale value obtaining module 101 is configured to obtain a grayscale value of a red, green, and blue (RGB) primary color weight of each pixel of an original image.

A first conversion module 102 is configured to convert the grayscale value of the RGB primary color weight into a normalized luminance value.

A second conversion module 103 is configured to convert the normalized luminance value of the RGB primary color weight into luminance values of a corresponding red, green, blue, and white (RGBW) sub-pixels.

A pattern detection module 104 is configured to detect a display mode of a pending pixel to be a text display mode.

A text rendering module 105 is configured to render the pixel based on the text display mode when the display mode of the pending pixel is the text display mode.

An image rendering module 106 is configured to render the pixel based on an image display mode when the display mode of the pending pixel is the image display mode.

A conversion output module 107 is configured to convert the luminance value of the pending pixel after being rendered into a corresponding grayscale value for output.

In this embodiment, the pattern detection module 104 includes components as follows.

A difference obtain unit 114 is configured to obtain the luminance difference and saturation difference between two pixels adjacent to the pending pixel.

A comparison unit 124 is configured to compare the luminance difference with a predetermined luminance difference threshold and to compare the saturation difference with a predetermined saturation difference threshold.

A pattern detection unit 134 is configured to detect the display mode of the pending pixel to be the text display mode upon conditions that the luminance difference is greater than the predetermined luminance difference threshold and the saturation difference is greater than the predetermined saturation difference threshold. Otherwise, the pattern detection unit 134 detects the display mode of the pending pixel to be the image display mode.

According to the pixel rendering device 10 of the present disclosure, the display mode of a pending pixel is detected to be a text display mode. If the display mode of a pending pixel is a text display mode, the pixel is rendered on the text display mode. If not, the pixel is rendered on the image display mode. The advantages of the present disclosure are as follows.

First, the actual resolution of a display panel does not lower even though the physical resolution of the display panel reduces.

Second, each piece of the pixel information was retained, which implies that no shown details are lost.

Third, the display mode of the pending pixel is detected and the text and image display modes are treated differently in the present disclosure. The display effect of the treated image display is smoother and better, especially, image display on humans. The display effect of the treated text display is sharper in black and white text and more accurate in details.

While the present invention has been described in connection with what is considered the most practical and preferred embodiments, it is understood that this invention is not limited to the disclosed embodiments but is intended to cover various arrangements made without departing from the scope of the broadest interpretation of the appended claims.

I claim:

1. A pixel rendering method, comprising:

obtaining a grayscale value of a red, green, and blue (RGB) primary color weight of each pixel in an original image and converting the grayscale value into a normalized luminance value;

converting the normalized luminance value of the RGB primary color weight into a luminance value of a corresponding red, green, blue, and white (RGBW) weight;

obtaining a luminance difference and a saturation difference between two pixels adjacent to the pending pixel;

comparing the luminance difference with a predetermined luminance difference threshold; comparing the saturation difference with a predetermined saturation difference threshold;

detecting whether the luminance difference is greater than the predetermined luminance difference threshold and whether the saturation difference is greater than the predetermined saturation difference threshold;

determining an display mode to be an text display mode if the luminance difference is greater than the predetermined luminance difference threshold and the saturation difference is greater than the predetermined saturation difference threshold;

determining the display mode to be an image display mode if the luminance difference is not greater than the predetermined luminance difference threshold or the saturation difference is not greater than the predetermined saturation difference threshold;

rendering the pending pixel based on the text display mode if the display mode of the pending pixel is on the text display mode; otherwise, rendering the pending pixel on the image display mode;

converting the luminance value of the pending pixel after being rendered into a corresponding grayscale value for output, wherein the rendering the pending pixel on the image display mode comprises:

obtaining luminance values of the RGBW sub-pixels of a first pixel, a second pixel, and a third pixel arranged adjacently from left to right in the same row, assigning the first pixel as the pending pixel, and calculating luminance values of the W sub-pixel, the R sub-pixel, the G sub-pixel, and the B sub-pixel of the pending pixel after being rendered according to the following formula:

$$W1_{out}=(W1+W2+W3)/3,\ R1_{out}=(R1+R2+R3)/3,$$

$$G1_{out}=(G1+G2+G3)/3,\ B1_{out}=(B1+B2+B3)/3,$$

where $W1_{out}$, $R1_{out}$, $G1_{out}$, and $B1_{out}$ are the luminance values of the W sub-pixel, the R sub-pixel, the G sub-pixel, and the B sub-pixel of the pending pixel after being rendered, respectively, W1, R1, G1, and B1 indicate the luminance values of the W sub-pixel, the R sub-pixel, the G sub-pixel, and the B sub-pixel of the first pixel, respectively, W2, R2, G2, and B2 indicate the luminance values of the W sub-pixel, the R sub-pixel, the G sub-pixel, and the B sub-pixel of the second pixel, respectively, and W3, R3, G3, and B3 indicate the luminance values of the W sub-pixel, the R sub-pixel, the G sub-pixel, and the B sub-pixel of the third pixel, respectively.

2. The pixel rendering method of claim 1, wherein the step of rendering the pending pixel on the text display mode comprises:

obtaining luminance values of the RGBW sub-pixels of a first pixel and a second pixel arranged adjacently from left to right in the same row, assigning the first pixel as the pending pixel, and calculating luminance values of the W sub-pixel, the R sub-pixel, the G sub-pixel, and the B sub-pixel of the pending pixel after being rendered according to the following formula:

$$P1=W1+(R1+G1+B1)/3,\ P2=W2+(R2+G2+B2)/3,$$

when P1>P2, $W1_{out}$=(P1+W2)/2, $R1_{out}$=P2, $G1_{out}$=P2, and $B1_{out}$=P2, when P1<P2, $W1_{out}$=P1, $R1_{out}$=(R1+R2)/2, $G1_{out}$=(G1+G2)/2, $B1_{out}$=(B1+B2)/2, where $W1_{out}$, $R1_{out}$, $G1_{out}$, and $B1_{out}$ are the luminance values of the W sub-pixel, the R sub-pixel, the G sub-pixel, and the B sub-pixel of the pending pixel after being rendered; W1, R1, G1, and B1 indicate the luminance values of the W sub-pixel, the R sub-pixel, the G sub-pixel, and the B sub-pixel of the first pixel, respectively; W2, R2, G2, and B2 indicate the luminance values of the W sub-pixel, the R sub-pixel, the G sub-pixel, and the B sub-pixel of the second pixel, respectively.

3. The pixel rendering method of claim 1, wherein the step of rendering the pending pixel on the text display mode comprises:

obtaining luminance values of the RGBW sub-pixels of a first pixel and a second pixel arranged adjacently from left to right in the same row, assigning the first pixel as the pending pixel, and calculating luminance values of the W sub-pixel, the R sub-pixel, the G sub-pixel, and the B sub-pixel of the pending pixel after being rendered according to the following formula:

$$P1=W1+(R1+G1+B1)/3,\ P2=W2+(R2+G2+B2)/3,$$

when P1>P2, $W1_{out}$=min {(P1+W2)/2,1}, $R1_{out}$=R2, $G1_{out}$=G2, $B1_{out}$=B2, when P1<P2, $W1_{out}$=W1, $R1_{out}$=min {(R1+P2)/2,1}, $G1_{out}$=min {(G1+P2)/2,1}, and $B1_{out}$=min {(B1+P2)/2,1}, where $W1_{out}$, $R1_{out}$, $G1_{out}$, and $B1_{out}$ are the luminance values of the W sub-pixel, the R sub-pixel, the G sub-pixel, and the B sub-pixel of the pending pixel after being rendered, respectively; W1, R1, G1, and B1 indicate the luminance values of the W sub-pixel, the R sub-pixel, the G sub-pixel, and the B sub-pixel of the first pixel, respectively; W2, R2, G2, and B2 indicate the luminance values of the W sub-pixel, the R sub-pixel, the G sub-pixel, and the B sub-pixel of the second pixel, respectively.

4. A pixel rendering method, comprising:

obtaining a grayscale value of a red, green, and blue (RGB) primary color weight of each pixel in an original image and converting the grayscale value into a normalized luminance value;

converting the normalized luminance value of the RGB primary color weight into a luminance value of a corresponding red, green, blue, and white (RGBW) weight;

determining a display mode of a pending pixel to be a text display mode or an image display mode;

rendering the pending pixel based on the text display mode if the display mode of the pending pixel is on the text display mode; otherwise, rendering the pending pixel on the image image display mode;

converting the luminance value of the pending pixel after being rendered into a corresponding grayscale value for output;

wherein the step of converting the luminance value of the normalized RGB primary color weight into the luminance value of the corresponding RGBW are calculated according to formulae as follows, $$W1=\min(k*R_0,k*G_0,k*B_0,W_{max}),R1=k*R_0-W_0,$$

$$G1=k*G_0-W_0,\ B1=k*B_0-W_0,$$

where k indicates a gain coefficient and k≥1 is established; W1, R1, G1, and B1 are the converted luminance value of RGBW sub-pixels, respectively; $W_0$, $R_0$, $G_0$, and $B_0$ are the luminance values of the RGBW sub-pixels before being converted, respectively; $W_{max}$ is the greatest luminance value of the W sub-pixel; and wherein the step of determining a display mode of a pending pixel to be the text display mode or the image display mode comprises:

obtaining a luminance difference and a saturation difference between two pixels adjacent to the pending pixel;

comparing the luminance difference with a predetermined luminance difference threshold; comparing the saturation difference with a predetermined saturation difference threshold;

detecting whether the luminance difference is greater than the predetermined luminance difference threshold and whether the saturation difference is greater than the predetermined saturation difference threshold;

determining the display mode to be the text display mode if the luminance difference is greater than the predetermined luminance difference threshold and the saturation difference is greater than the predetermined saturation difference threshold;

determining the display mode to be the image display mode if the luminance difference is not greater than the predetermined luminance difference threshold or the saturation difference is not greater than the predetermined saturation difference threshold;

wherein the step of rendering the pending pixel on the picture display mode comprises:

obtaining luminance values of the RGBW sub-pixels of a first pixel, a second pixel, and a third pixel arranged adjacently from left to right in the same row, assigning the first pixel as the pending pixel, and calculating luminance values of the W sub-pixel, the R sub-pixel, the G sub-pixel, and the B sub-pixel of the pending pixel after being rendered according to the following formula:

$$W1_{out}=a_1*W1+a_2*W2+a_3*W3,\ R1_{out}=a_1*R1+a_2*R2+a_3*R3,$$

$$G1_{out}=a_1*G1+a_2*G2+a_3*G3,\ B1_{out}=a_1*B1+a_2*B2+a_3*B3,$$

where $a_1$, $a_2$, and $a_3$ are all weighting coefficients, and $0\le a_1\le 1$, $0\le a_2\le 1$, $0\le a_3\le 1$, and $a_1+a_2+a_3=1$; $W1_{out}$, $B1_{out}$, $G1_{out}$, and $B1_{out}$ are the luminance values of the W sub-pixel, the R sub-pixel, the G sub-pixel, and the B sub-pixel of the pending pixel after being rendered, respectively; W1, R1, G1, and B1 indicate the luminance values of the W sub-pixel, the R sub-pixel, the G sub-pixel, and the B sub-pixel of the first pixel, respectively; W2, R2, G2, and B2 indicate the luminance values of the W sub-pixel, the R sub-pixel, the G sub-pixel, and the B sub-pixel of the second pixel, respectively; W3, R3, G3, and B3 indicate the luminance values of the W sub-pixel, the R sub-pixel, the G sub-pixel, and the B sub-pixel of the third pixel, respectively.

5. The pixel rendering method of claim 4, wherein the step of rendering the pending pixel on the text display mode comprises:

obtaining luminance values of the RGBW sub-pixels of a first pixel and a second pixel arranged adjacently from left to right in the same row, assigning the first pixel as the pending pixel, and calculating luminance values of the W sub-pixel, the R sub-pixel, the G sub-pixel, and the B sub-pixel of the pending pixel after being rendered according to the following formula:

$$P1=W1+(R1+G1+B1)/3,\ P2=W2+(R2+G2+B2)/3,$$

when P1>P2, $W1_{out}$=(P1+W2)/2, $R1_{out}$=P2, $G1_{out}$=P2, and $B1_{out}$=P2, when P1<P2, $W1_{out}$=P1, $R1_{out}$=(R1+R2)/2, $G1_{out}$=(G1+G2)/2, $B1_{out}$=(B1+B2)/2, where $W1_{out}$, $R1_{out}$, $G1_{out}$, and $B1_{out}$ are the luminance values of the W sub-pixel, the R sub-pixel, the G sub-pixel, and the B sub-pixel of the pending pixel after being rendered; W1, R1, G1, and B1 indicate the luminance values of the W sub-pixel, the R sub-pixel, the G sub-pixel, and the B sub-pixel of the first pixel, respectively; W2, R2, G2, and B2 indicate the luminance values of the W sub-pixel, the R sub-pixel, the G sub-pixel, and the B sub-pixel of the second pixel, respectively.

6. The pixel rendering method of claim 4, wherein the weighting coefficients $a_1$ equals 0.25, $a_2$ equals 0.5 and $a_3$ equals 0.25.

7. The pixel rendering method of claim 4, wherein the step of rendering the pending pixel on the text display mode comprises:

obtaining luminance values of the RGBW sub-pixels of a first pixel and a second pixel arranged adjacently from left to right in the same row, assigning the first pixel as the pending pixel, and calculating luminance values of the W sub-pixel, the R sub-pixel, the G sub-pixel, and the B sub-pixel of the pending pixel after being rendered according to the following formula:

$$P1=W1+(R1+G1+B1)/3,\ P2=W2+(R2+G2+B2)/3,$$

when P1>P2, $W1_{out}$=min {(P1+W2)/2,1}, $R1_{out}$=R2, $G1_{out}$=G2, $B1_{out}$=B2, when P1<P2, $W1_{out}$=W1, $R1_{out}$=min {(R1+P2)/2,1}, $G1_{out}$=min {(G1+P2)/2,1}, and $B1_{out}$=min {(B1+P2)/2,1}, where $W1_{out}$, $R1_{out}$, $G1_{out}$, and $B1_{out}$ are the luminance values of the W sub-pixel, the R sub-pixel, the G sub-pixel, and the B sub-pixel of the pending pixel after being rendered, respectively; W1, R1, G1, and B1 indicate the luminance values of the W sub-pixel, the R sub-pixel, the G sub-pixel, and the B sub-pixel of the first pixel, respectively; W2, R2, G2, and B2 indicate the luminance values of the W sub-pixel, the R sub-pixel, the G sub-pixel, and the B sub-pixel of the second pixel, respectively.

* * * * *